US008557004B2

(12) United States Patent
Katayama

(10) Patent No.: US 8,557,004 B2
(45) Date of Patent: Oct. 15, 2013

(54) METHOD FOR DEWATERING WATER-CONTAINING COAL

(75) Inventor: Yukuo Katayama, Tokyo (JP)

(73) Assignees: Yukuo Katayama, Tokyo (JP); K.E.M. Corporation, Tokyo (JP)

( * ) Notice: Subject to any disclaimer, the term of this patent is extended or adjusted under 35 U.S.C. 154(b) by 887 days.

(21) Appl. No.: 10/564,988

(22) PCT Filed: Jul. 16, 2004

(86) PCT No.: PCT/JP2004/010207

§ 371 (c)(1),
(2), (4) Date: Jan. 18, 2006

(87) PCT Pub. No.: WO2005/007783

PCT Pub. Date: Jan. 27, 2005

(65) Prior Publication Data

US 2006/0156622 A1 Jul. 20, 2006

(30) Foreign Application Priority Data

Jul. 18, 2003 (JP) ..... 2003-277038

(51) Int. Cl.
*C10L 9/00* (2006.01)
*C10L 5/02* (2006.01)

(52) U.S. Cl.
USPC ..... 44/626; 44/569; 44/596; 44/597; 44/621

(58) Field of Classification Search
USPC ..... 44/626
See application file for complete search history.

(56) References Cited

U.S. PATENT DOCUMENTS

| | | | | | |
|---|---|---|---|---|---|
| 2,824,790 | A | * | 2/1958 | Haig et al. | 44/568 |
| 3,529,981 | A | * | 9/1970 | Hawkins et al. | 264/211.11 |
| 4,216,082 | A | * | 8/1980 | Verschuur | 209/10 |
| 4,477,257 | A | * | 10/1984 | Koppelman et al. | 44/632 |
| 4,541,929 | A | * | 9/1985 | Janusch | 210/217 |
| 4,607,796 | A | * | 8/1986 | Enikolopov et al. | 241/3 |
| 4,702,745 | A | * | 10/1987 | Kamei et al. | 44/592 |
| 4,758,244 | A | | 7/1988 | Harvey et al. | |
| 4,762,527 | A | | 8/1988 | Beshore et al. | |

(Continued)

FOREIGN PATENT DOCUMENTS

| | | |
|---|---|---|
| JP | A-54-024457 | 2/1979 |
| JP | A 59-184293 | 10/1984 |

(Continued)

OTHER PUBLICATIONS

Racovalis et al; "Effect of processing conditions on organics in wastewater from hydrothermal dewatering of low-rank coal"; FUEL; vol. 81; pp. 1369-1378; 2002.

Favas et al; "Hydrothermal dewatering of lower rank coals. 1. Effects of process conditions on the properties of dried product"; FUEL; vol. 82; pp. 53-57; 2003.

(Continued)

*Primary Examiner* — Ellen McAvoy
*Assistant Examiner* — Ming Cheung Po
(74) *Attorney, Agent, or Firm* — Oliff & Berridge, PLC

(57) ABSTRACT

A method for dewatering water-containing coal which includes heating the water-containing coal at a temperature of 100 to 350° C. under a pressure not less than a saturated steam pressure at the temperature for the heating, while applying a shearing force of 0.01 to 20 MPa to the coal, in a sealed vessel. The method is novel and allows the production of dewatered coal which is inhibited from reabsorbing water after dewatering and is also inhibited from absorbing oxygen after dewatering.

17 Claims, 1 Drawing Sheet

(56) References Cited

U.S. PATENT DOCUMENTS

| | | | |
|---|---|---|---|
| 4,895,577 | A | 1/1990 | Chornet et al. |
| 4,933,086 | A | 6/1990 | McMahon et al. |
| 2004/0237809 | A1 | 12/2004 | McIntosh et al. |
| 2006/0156622 | A1 | 7/2006 | Katayama |

FOREIGN PATENT DOCUMENTS

| | | | |
|---|---|---|---|
| JP | A 61-252475 | | 11/1986 |
| JP | A-62-136299 | | 6/1987 |
| JP | A-62-225585 | | 10/1987 |
| JP | A-3-76790 | | 4/1991 |
| JP | A-8-168800 | | 7/1996 |
| JP | A-10-113700 | | 5/1998 |
| JP | A 2000-169274 | | 6/2000 |
| WO | WO 01/54819 | A1 | 8/2001 |
| WO | WO 02/27251 | A1 | 4/2002 |
| WO | WO 02/27251 AI | | 4/2002 |
| WO | WO 2004072212 | A1 * | 8/2004 |
| WO | WO 2005/007783 | A1 | 1/2005 |

OTHER PUBLICATIONS

Favas et al; "Hydrothermal dewatering of lower rank coals. 2. Effects of coal characteristics for a range of Australian and international coals"; FUEL; vol. 82; pp. 59-69; 2003.

Favas et al; "Hydrothermal dewatering of lower rank coals. 3. High-concentration slurries from hydrothermally treated lower rank coals"; FUEL; vol. 82; pp. 71-79; 2003.

Jul. 20, 2009 Office Action issued in copending U.S. Appl. No. 11/662,969, 13 pgs.

Dec. 28, 2004 International Search Report issued in PCT/JP2004/013551, 1 pg.

Dec. 29, 2009 European Search Report.

Supplementary European Search Report for Application No. EP 04 74 7672; mailed Dec. 29, 2009.

Oct. 28, 2010 Office Action issued in U.S. Appl. No. 11/662,969.

Jul. 16, 2010 Office Action issued in Canadian Application No. 2,580,806.

Apr. 14, 2011 Office Action issued in U.S. Appl. No. 11/662,969.

Feb. 8, 2012 Office Action issued in U.S. Appl. No. 11/662,969.

Nov. 21, 2012 Office Action issued in U.S. Appl. No. 11/662,969.

* cited by examiner

METHOD FOR DEWATERING WATER-CONTAINING COAL

FIELD OF THE INVENTION

The present invention relates to a method for dewatering water-containing coal, a method for producing a water slurry of the dewatered coal, and a method for producing pulverized coal and briquette.

BACKGROUND OF THE INVENTION

Water-containing coal, for example, brown coal has a high water content and a number of relatively large pores in its structure. Even if the water-containing coal is pulverized and dried for use, the size and the number of the pores hardly change. Therefore, the coal which is obtained by drying the water-containing coal has the risk of oxygen entering the pores during storage or transportation of the coal to cause slow oxidization reaction to cause spontaneous firing. Therefore, such water-containing coal is utilized in extremely limited areas near coalfields under the present circumstances.

The methods for dewatering water-containing coal, for example, brown coal by performing hydrothermal treatment for the coal at a temperature of 250 to 350° C. under a pressure of 4 to 17.2 MPa are tried (see the following non-patent documents 1 to 4). It is reported that when the hydrothermal treatment is carried out under such a pressure, the brown coal is dewatered and the volume of the pores in the coal decreases (see non-patent document 1).

However, the decrease in the pore volume is not sufficient, and the above described problem is not solved sufficiently yet. The mixture (water slurry) of the coal, which is dewatered by the above described methods, and water requires the water content which is twice to four times as high as that of the mixture of ordinary bituminous coal and water in order to obtain about the same viscosity as that of the mixture of ordinary bituminous coal and water, which is suitable for transportation, and therefore, is not economical. The treatment cost of dewatering and draining of water accompanying the dewatering is high, and therefore, these methods are not put into actual use.

non-patent document 1: "Effect of processing conditions on organics in wastewater from hydrothermal dewatering of low-rank coal" by L. Racovalis et al., Fuel, vol. 81, pages 1369 to 1378, 2002 non-patent document 2: "Hydrothermal dewatering of lower rank coals. 1. Effects of process conditions on the properties of dried product" by George Favas, et al., Fuel, vol. 82, pages 53 to 57, 2003 non-patent document 3: "Hydrothermal dewatering of lower rank coals. 2. Effects of coal characteristics for a range of Australian and international coals" by George Favas et al., Fuel, vol. 82, pages 59 to 69, 2003 non-patent document 4: "Hydrothermal dewatering of lower rank coals. 3. High-concentration slurries from hydrothermally treated lower rank coals" by George Favas et al., Fuel, vol. 82, pages 71 to 79, 2003

SUMMARY OF THE INVENTION

The present invention provides a novel dewatering method capable of providing dewatered coal which is inhibited from reabsorbing water after dewatering and which is inhibited from absorbing oxygen after dewatering. Therefore, by the method, a mixture (water slurry) with a proper viscosity and a proper water content, which includes water removed from water-containing coal and the dewatered coal, dewatered coal which is inhibited from spontaneously firing after dewatering, and briquette constituted of a mixture including the coal and bitumen can be manufactured at low cost.

Water-containing coal, for example, brown coal, contains a large amount of water. The water is substantially constructed by water which exists in pores of the coal structure and water existing by being bonded to the coal by a Van der Waals force. The present inventor made a study of efficiently removing the water from the water-containing coal and obtaining the products suitable for transportation, for example, a water slurry, pulverized coal and briquette of which water contents are reduced to about that of bituminous coal. As a result, the inventor has found out that by heating water-containing coal in a sealed vessel under a predetermined pressure at a predetermined temperature and by applying a predetermined shearing force to the water-containing coal, not only water can be efficiently removed from the water-containing coal, but also re-absorption of water and absorption of oxygen after dewatering are inhibited, and the products suitable for transportation as described above can be manufactured at low cost.

Namely, the present invention is (1) a method for dewatering water-containing coal, comprising heating the water-containing coal at a temperature of 100° C. to 350° C. under a pressure not less than a saturated steam pressure at the temperature for the heating, while applying a shearing force of 0.01 MPa to 20 MPa to the water-containing coal, in a sealed vessel.

According to the present invention, it is considered that water entering the pores in water-containing coal structure and water bonded to the coal by a Van der Waals force are removed from the water-containing coal, and the pore structure included in the water-contained coal is broken. Accordingly, the pore volume (percentage of void) of the water-containing coal is significantly reduced, and re-absorption of water and absorption of oxygen after dewatering are inhibited As preferable modes, (2) the method according to the above described (1), wherein the shearing force is applied by a stirring blade provided in the sealed vessel, (3) the method according to the above described (1) or (2), wherein the temperature for the heating is 150° C. to 300° C., (4) the method according to any one of the above described (1) to (3), wherein the pressure during the heating is not more than the saturated steam pressure at the temperature for the heating +0.5 MPa, provided that the pressure does not exceed 17.8 MPa, (5) the method according to any one of the above described (1) to (4), wherein the shearing force is 0.1 MPa to 10 MPa, (6) the method according to any one of the above described (1) to (5), wherein the heating is conducted in a period of from three minutes to five hours, (7) the method according to any one of the above described (1) to (6), wherein the water-containing coal is brown coal containing 25 weight % to 85 weight % of water, calculated on the basis of the water-containing coal can be cited.

Further, the present invention is (8) a method comprising providing a mixture containing water which is removed from water-containing coal and coal from which the water is removed in a sealed vessel as obtained according to the method as set forth in any one of the above described (1) to (7), and subsequently removing water from the mixture existing in the sealed vessel or adding water to the mixture, to adjust a water content in the mixture to 30 weight % to 50 weight %, calculated on the basis of the mixture.

As a preferable mode, (9) the method according to the above described (8), wherein the water content in the mixture obtained by removing water or adding water is 40 weight % to 50 weight % can be cited.

Further, the present invention is

(10) a method comprising providing a mixture containing water which is removed from water-containing coal and coal from which the water is removed in a sealed vessel as obtained according to the method as set forth in any one of the above described (1) to (7), subsequently removing the water from the mixture to isolate the coal from which the water was removed.

As a preferable mode,

(11) the method according to the above described (10), wherein water is removed from the mixture so that the coal contains not more than 15 weight % of water, based a total amount of the coal and water, and

(12) the method according to the above described (11), wherein water is removed from the mixture so that the coal substantially does not contain water can be cited.

Further, the present invention is

(13) a method comprising adding 1 weight % to 25 weight % of bitumen, calculated on the basis of dry coal, to the dewatered coal obtained according to the method as set forth in any one of the above described (10) to (12).

As preferable modes,

(14) the method according to the above described (13), wherein an amount of the bitumen is 5 weight % to 20 weight %, based on the dry coal, and

(15) the method according to the above described (13) or (14), wherein the bitumen is natural asphalt, petroleum asphalt or coal tar can be cited.

EFFECT OF THE INVENTION

The present invention provides a novel method for dewatering which is capable of obtaining dewatered coal which is inhibited from reabsorbing water after dewatering and is inhibited from absorbing oxygen after dewatering. Therefore, according to the method, a mixture (water slurry) having proper viscosity and water content, which contains water which is removed from water-containing coal and the coal from which the water is removed, dewatered coal inhibited from spontaneous firing after dewatering and a briquette constituted of a mixture containing the coal and bitumen can be manufactured at low cost. Low-rank coal such as brown coal which is buried in large amount but can be used only in the nearby coalfields due to spontaneous firing after being dried can be effectively used.

DESCRIPTION OF THE PREFERRED EMBODIMENTS

In the present invention, the water-containing coal which is subjected to dewatering is not particularly limited. For example, low-rank water-containing coals such as brown coal, lignite and sub-bituminous coal are cited. For the water content of the water-containing coal, calculated on the basis of the water-containing coal, the upper limit is preferably 85 weight %, more preferably 70 weight %, and the lower limit is preferably 25 weight %, more preferably 30 weight %, and even more preferably 40 weight %. The brown coal with the water content of 40 to 70 weight %, calculated on the basis of the water-containing coal, is used particularly preferably. As for the water-containing coal of which water content exceeds the above described upper limit, it is preferable to remove the water therefrom in advance by pressurization by, for example, a roll press or the like, before or after the following pulverization to bring the water content into the above described range.

The water-containing coal is preferably used by being pulverized into a predetermined particle size. As for the particle size, the upper limit is preferably 200 meshes, more preferably 150 meshes, and even more preferably 100 meshes. The lower limit is preferably 3 meshes, more preferably 30 meshes, and even more preferably 50 meshes. With the particle size of the water-containing coal of less than the above described lower limit, the coal easily sediments when it is converted into a water slurry, and with the particle size exceeding the above described upper limit, the viscosity of the water slurry increases and extra power is consumed for pulverization.

In the present invention, the water-containing coal is introduced into a sealed vessel and dewatered. The sealed vessel should be capable of heating the water-containing coal under pressurization and capable of applying a shearing force to the water-containing coal. For example, a kneader having a screw type stirring blade of a single shaft or a twin shaft, preferably a twin shaf0t, or, for example, a kneader including a screw used in a so-called screw feeder for making ground meat or ground fish can be used. The sealed vessel may be of either a batch type or a continuous type. Any continuous type sealed vessel, that can continuously carry out loading of the water-containing coal and withdrawing of the dewatered coal, and withdrawing of gaseous or liquid water while keeping the predetermined conditions of the present invention, is suitably used.

As for the heating temperature, the upper limit is 350° C., preferably 300° C., and more preferably 250° C., and the lower limit is 100° C., preferably 150° C., and more preferably 200° C. At the temperature exceeding the above described upper limit, the apparatus cost becomes extremely high, and at the temperature lower than the above described lower limit, the effect of the present invention by dewatering cannot be obtained. As for the heating time, the upper limit is preferably five hours, more preferably three hours, still more preferably one hour, and particularly preferably 30 minutes, and the lower limit is preferably 3 minutes, more preferably 5 minutes, and still more preferably 10 minutes. By the heating, heat of preferably 2300 kj at the maximum is given per 1 kg of water contained in the water-containing coal.

The lower limit of the pressure during heating is the pressure not less than saturated steam pressure at the temperature for the heating, preferably the pressure not less than the saturated steam pressure at the temperature for the heating +0.1 MPa, and more preferably the pressure not less than the saturated steam pressure at the temperature for the heating +0.2 MPa. By keeping the pressure, the water removed from the water-containing coal can be kept in the liquid state, and therefore, unnecessary latent heat of vaporization does not need to be given during dewatering. The upper limit of the pressure is preferably the saturation steam pressure at the temperature for the heating +1.0 MPa, more preferably the saturation steam pressure at the temperature for the heating +0.5 MPa, and still more preferably the saturation steam pressure at the temperature for the heating +0.3 MPa. However, the maximum pressure during the heating is preferably the saturation steam pressure at 350° C. which is the maximum value of the temperature for the heating +1.0 MPa (=17.8 MPa). The pressure exceeding the upper limit is not preferable, because there is not a large difference in the effect, and the apparatus cost becomes higher. The pressure during the heating can be adjusted by preferably using an inert gas, such as nitrogen and argon, for example, in addition to steam which occurs from the water-containing coal by heating.

A shearing force is applied to the water-containing coal during the above described heating in the present invention. The upper limit of the shearing force is 20 MPa, preferably 10 MPa, more preferably 5 MPa, and the lower limit is 0.01 MPa, preferably 0.1 MPa, and more preferably 1.0 MPa. With the shearing force exceeding the above described upper limit, the motor power load becomes large, and with the shearing force less than the above described lower limit, the coal is insufficiently dewatered, and the effect of the present invention by the dewatering cannot be obtained. The shearing force is applied by the stirring blade provided in the sealed vessel. The shearing force in the present invention can be obtained as follows. The reference material with known viscosity (20° C.), for example, Standard LIQUIDS FOR CALIBRATING VISCOMETERS (JIS Z8809) of JS100 viscosity 86 mPa·s, JS1400 viscosity 12 Pa·s, and JS160000 viscosity 140 Pa·s made by NIPPON GREASE Co., Ltd. are respectively put into, for example, the sealed vessel shown in FIG. 2 (twin-shaft screw type kneader with in-vessel effective volume of 8 litters, in-vessel length of 600 mm, vessel long diameter of 160 mm, vessel short diameter of 100 mm, stirring blade diameter of 96 mm, 13 stirring blades in total per shaft, with its pitch being 70 mm at the nearest spot to the coal supply port, decreasing by 4 mm toward the downstream side in sequence, and being 22 mm at the nearest spot to the product withdrawing port), and at the temperature of 20° C., torque exerted on the rotary shaft is measured by rotating the equipped stirring blades at 60 rpm. As for the value exceeding 140 Pa·s in viscosity (20° C.), torque is measured as described above by using a mixed solution prepared by mixing kerosene into asphalt (for example, the mixed solution with the viscosity (20° C.) of 6400 Pa·s measured by using a BS type viscometer made by TOKI SANGYO CO., LTD.). In this case, the above described measuring solution is poured until the entire stirring blades in the sealed vessel are completely immersed in the solution. Torque in a vacant state in which the measuring solution is not put into the sealed vessel is measured (shearing force at this time is set at zero). In this manner, the torque of each measuring solution of which viscosity is known is read, and the shearing force is obtained from the following formula to obtain relationship between the torque and shearing force shown in FIG. 1, for example.

$$\text{Shearing force (Pa)}=[\text{viscosity (Pa·s)}\times\text{shearing speed (s}^{-1})]/\text{read value of torque} \quad \text{(Formula 1)}$$

In the above described formula, the shearing speed is expressed by the following formula. In the following formula, sin 3.5° is the value peculiar to the device shown in FIG. 2. The value is obtained from the shape of the stirring blade, and differs in accordance with the shape of the stirring blade.

$$\text{Shearing speed (s}^{-1})=\approx 2\times 3.14\times(\text{rotational frequency per second})\div\sin 3.5° \quad \text{(Formula 2)}$$

In this manner, from the above described relationship, the shearing force can be obtained by measuring torque exerted on the rotary shaft. For example, as for the sealed vessel shown in FIG. 2, the shearing force can be obtained from the relationship shown in FIG. 1. Since the shaft torque of the sealed vessel including the stirring blades is peculiar to the apparatus, the torque changes if the apparatus is changed. Accordingly, for each apparatus to be used, the relationship between the torque and shearing force as shown in FIG. 1 has to be obtained under the same condition as described above. In this manner, by measuring the torque exerted on the rotary shaft, the shearing force can be obtained in any apparatus.

According to the above described method of the present invention, a mixture (water slurry) containing the water removed from the water-containing coal and the coal from which the water is removed is obtained in the sealed vessel after dewatering. The water content of the mixture is determined by the water content of the water-containing coal which is used. The mixture can be applied to power generation, gasification or the like in the form of a water slurry in a remote area by being transported or in the area near the coalfields without transportation. The water content of the mixture can be increased or decreased in accordance with the use form. The water content of the mixture is preferably 30 to 50 weight %, calculated on the basis of the mixture, and more preferably 40 to 50 weight %. In that concentration, the viscosity (20° C.) of the mixture can be made preferably 2,000 to 4,000 centipoises (cP=mPa·s), and more preferably about 1,000 centipoises (cP=mPa·s). Thereby, the water slurry suitable for handling such as transportation can be obtained. The method for making the concentration of the mixture in the above described range is not limited. Preferably, it is carried out by removing water from the mixture obtained in the sealed vessel after dewatering or adding water to the mixture. Water can be withdrawn as steam from the mixture in the sealed vessel. Thereby, in one step with the sealed vessel, the water slurry of a desired concentration can be produced by using the water contained in the water-containing coal, and the apparatus can be simplified. The water obtained from the water-containing coal contains a small amount of organic substances derived from the water-containing coal which is used. This works as a surface active agent, and therefore, adding a surface active agent to the above described water slurry can be omitted.

The water which is removed from the water-containing coal is removed from the mixture existing in the sealed vessel, and the coal from which the water is preferably removed substantially completely can be also obtained. In this case, the water content is preferably 0 to 15 weight % with respect to a total amount of the coal and the water, and is more preferably 5 to 10 weight %. Thereby, the water-containing coal can be made coal having substantially the same water content as that of bituminous coal. The coal which is dewatered by the dewatering method of the present invention is inhibited from spontaneous firing during transportation or storage. By preferably giving the heat of 5100 kJ at the maximum in total per 1 kg of the water contained in the water-containing coal, the coal from which water is substantially completely removed can be obtained.

In the present invention, the dewatered coal which is obtained as described above, can be doped with preferably 1 to 25 weight % of bitumen, more preferably 5 to 20 weight % of bitumen, calculated on the basis of the dry coal. The coal doped with the bitumen can be preferably used in manufacturing briquette. As the bitumen, natural asphalt, petroleum asphalt or coal tar is preferably used.

Hereinafter, the present invention will be described in more detail with reference to the examples, but the present invention is not limited to these examples.

The water-containing coal used in the examples is brown coal, which has the properties in the following Table 1.

TABLE 1

| | Brown coal |
|---|---|
| Water content | 58.80 weight % |
| Ash content | 0.37 weight % |
| Volatile matter content | 22.18 weight % |

TABLE 1-continued

| Brown coal | |
|---|---|
| Fixed carbon | 18.65 weight % |
| Pore volume (percentage of void) | 0.81 ml/g |

The water content, the ash content, the volatile matter content and the fixed carbon in the above described Table 1 were measured based on the Proximate analysis method (JIS M8812). The pore volume was measured by the BET method by using the coal (water content of 0%) after dried at 107° C. for one hour.

As for measurement of torque, Yamasaki P-100R Type Rotational Torque Meter was used when the torque exceeded 140 kg·cm, and when the torque is not more than the above described torque value, Yamasaki SS-50R type Rotational Torque Meter was used.

Example 1

As the sealed vessel, the twin-shaft screw type kneader as shown in FIG. 2 was used. The effective internal volume of the vessel is 8 litters. In FIG. 2, reference numeral 1 designates a coal supply port, reference numeral 2 designates a screw, reference numeral 3 designates a valve, reference numeral 4 designates a steam extracting valve, reference numeral 5 designates an asphalt injecting valve, and reference numeral 6 designates a product removing valve. The brown coal having the above described properties were previously pulverized into 30 to 100 meshes. 10 kg of the pulverized brown coal was prepared in the vessel. Then, after the pressure inside the vessel was made 0.7 MPa with a nitrogen gas, heating was started while the screw was rotated to adjust the temperature to 170° C. Immediately after the temperature reached this temperature, the pressure inside the vessel was adjusted to 1 MPa, and the torque exerted on the stirring shaft was measured, and by using the relationship between the torque and shearing force shown in FIG. 1, the shearing force was adjusted to 0.1 MPa. The treatment was conducted for an hour with the pressure, temperature and shearing force inside the vessel kept at the above described values and water was removed from the brown coal. Then, the vessel was cooled to the ambient temperature and the slurry was taken out. The same experiments were carried out with the heating time changed to three hours and five hours. The viscosities (20° C.) and the water contents of the obtained water slurries were shown in the following Table 2.

TABLE 2

| Treatment time | 1 hour | 3 hours | 5 hours |
|---|---|---|---|
| Viscosity (cP) | 10,000 | 3,000 | 1,000 |
| Water content (weight %) | 32.0 | 37.0 | 42.0 |

In Table 2, the slurry viscosities were measured by using the BS type viscometer made by TOKI SANGYO CO., LTD. The water content shows the weight of the water as the slurry medium with respect to the water slurry weight. Since it was impossible to measure the water weight as the slurry medium, the water content was obtained by assuming that the water content was the same as those of the slurry media of the bituminous water slurry having the same viscosity (20° C.).

Example 2

Example 2 was carried out in the same manner as Example 1 except that heating was conducted at 200° C. under the pressure of 2 MPa for one hour and heating was conducted at 250° C. under the pressure of 4 MPa for one hour. The viscosities (20° C.) of the obtained water slurries were shown in the following Table 3.

TABLE 3

| Treatment temperature | 170° C. | 200° C. | 250° C. |
|---|---|---|---|
| Viscosity (cP) | 10,000 | 4,000 | 800 |

From the result of Example 1, it is found out that with long treatment time, the water slurry with low viscosity is obtained. From the result of Example 2, it is found out that with the higher treatment temperature, the water slurry with lower viscosity is obtained. From the fact that the amount of water as the medium in the water slurry increased, it is obvious that dewatering of the brown coal advanced more as the viscosity of the water slurry reduced.

Comparative Example 1

The treatment was carried out similarly to Example 1 except that heating was conducted at 250° C. under the pressure of 4 MPa for one hour with the shearing force set at 0.001 MPa. Dewatering the brown coal apparently occurred, but when the mixture was left for a while, most of the water, which had once removed from the brown coal, entered the brown coal again, and the slurry did not have the suitable properties.

Example 3

The single-shaft pressing/heating type kneading device having the stirring blade described in Japanese Patent Application Laid-open No. 2000-169274 was used. The brown coal shown in Table 1 was pulverized into 30 to 100 meshes. 15 kg of the pulverized brown coal was supplied in the tank of the device. Then, after the pressure inside the tank was made 0.7 MPa with a nitrogen gas, heating was started with the screw rotated, and the temperature was adjusted to 170° C. Immediately after the temperature reached this temperature, the pressure inside the tank was adjusted to 1 MPa, and the torque exerted on the stirring shaft was measured, and by using the relationship between the torque and shearing force prepared in advance, the shearing force was adjusted to 1 MPa. The treatment was conducted for an hour with the pressure, temperature and shearing force inside the tank kept at the above described values, and water was removed from the brown coal. Then, the tank was cooled to the ambient temperature and the water slurry was taken out. The viscosity (20° C.) of the obtained water slurry was 900 centipoises (cP=mPa·s). The water content was 44 weight % as a result of assuming it from the water content as the slurry medium of the bituminous coal water slurry having the same viscosity (20° C.) as the obtained water slurry as in Example 1.

Example 4

Similarly to Example 3, the pulverized brown coal was prepared in the tank of the above described device. Then, after the pressure inside the tank was made about 0.79 MPa with a nitrogen gas, heating was conducted while the shearing force of 1 MPa was applied by rotating the screw, and the temperature was caused to reach 170° C. During the heating, the pressure inside the tank was adjusted to about 0.79 MPa (the saturated steam pressure at 170° C.) by properly opening the steam withdrawing valve which was mounted to the upper portion of the tank. After the temperature reached 170° C., steam was removed by continuously opening the steam withdrawing valve while the above described temperature and pressure were kept. After one hour from the start of the above described operation, all the water remaining in the vessel was evaporated by fully opening the steam withdrawing valve while the temperature was kept at 170° C. The properties of the brown coal after the water was removed therefrom are shown in Table 4.

TABLE 4

| | |
|---|---|
| Water content | 8.47 weight % |
| Ash content | 1.11 weight % |
| Volatile matter content | 46.12 weight % |
| Fixed carbon | 44.30 weight % |
| Pore volume (percentage of void) | 0.26 ml/g |

The water content in the brown coal was able to be significantly reduced by the above described treatment. It is found out that the pore volume was able to be significantly reduced in addition. Thereby, the favorable dry coal in which spontaneous firing can be inhibited and the water removed from the brown coal does not enter the pores of the brown coal again was obtained.

Example 5

Example 5 was carried out in the same manner as in Example 4, water was removed from the brown coal and the water was evaporated. Next, with the temperature kept at 170° C., 10 weight % of petroleum asphalt, calculated on the basis of the dry coal was injected into the vessel via the asphalt injecting valve provided at the downstream side of the tank. Then, after the screw was rotated to mix the content for 15 minutes, the mixture of the dewatered brown coal and the petroleum asphalt was removed from the product removing valve. Then, the mixture was conveyed to the compression molding machine to produce briquette. The hardness of the briquette was 60 weight % in tumble strength (JIS K2151, 6.2), and the briquette had substantially the same hardness as the briquette produced from bituminous coal.

INDUSTRIAL APPLICABILITY

Figure 1:
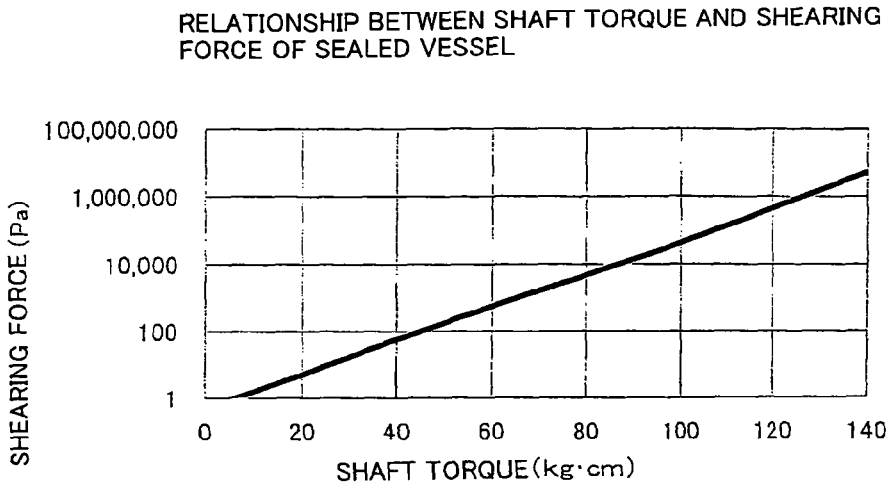
FIG. 1 is a diagram showing relationship between torque and a shearing force in a kneader shown in FIG. 2.
Figure 2:
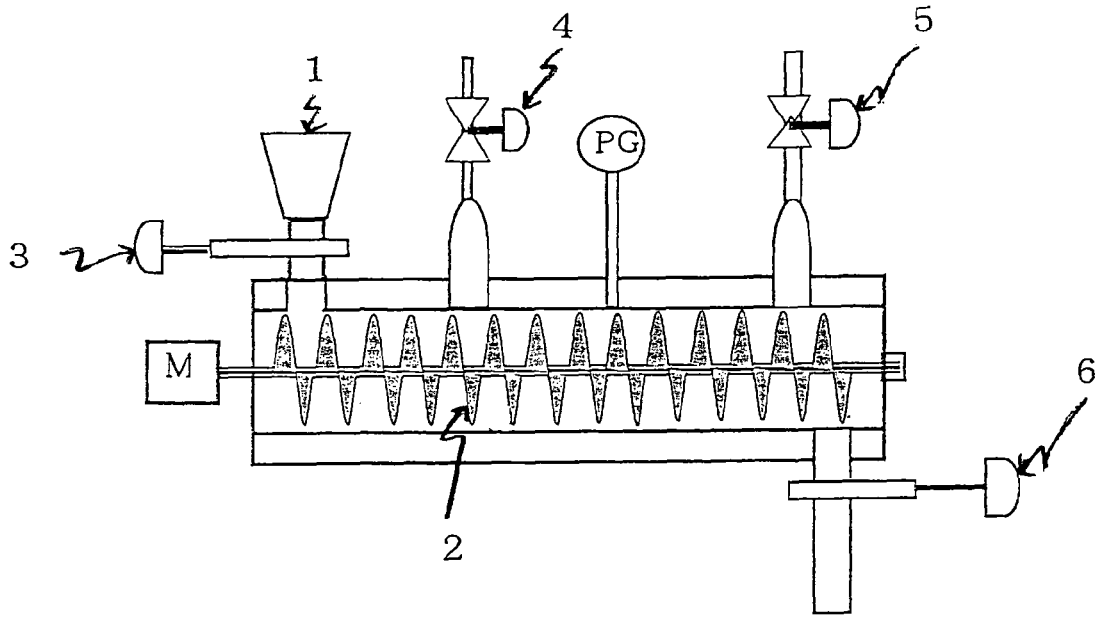
FIG. 2 is an electrical heating twin-shaft screw type kneader used in the examples.

According to the present invention, the mixture (water slurry) which has proper viscosity and water content, and contains water removed from the water-containing coal and the dewatered coal, the dewatered coal inhibited from spontaneously firing after dewatering, and the briquette constituted of the mixture of the coal and bitumen can be produced.

The invention claimed is:

1. A method for dewatering and reducing pore volume of water-containing coal, comprising heating the water-containing coal at a temperature of 100° C. to 350° C. under a pressure not less than a saturated steam pressure at the temperature for the heating, while simultaneously applying a shearing force of 0.01 MPa to 20 MPa to the water-containing coal, in a sealed vessel, to obtain a mixture of coal from which water has been removed and water which has been removed from the water-containing coal.

2. The method according to claim 1, wherein the shearing force is applied by a stirring blade provided in the sealed vessel.

3. The method according to claim 1, wherein the temperature for the heating is 150° C. to 300° C.

4. The method according to claim 1, wherein the pressure during the heating is not more than the saturated steam pressure at the temperature for the heating +0.5 MPa, provided that the pressure does not exceed 17.8 MPa.

5. The method according to claim 1, wherein the shearing force is 0.1 MPa to 10 MPa.

6. The method according to claim 1, wherein the heating is conducted in a period of from three minutes to five hours.

7. The method according to claim 1, wherein the water-containing coal is brown coal containing 25 weight % to 85 weight % of water, calculated on the basis of the water-containing coal.

8. A method for preparing slurry, comprising:

obtaining a mixture of coal from which water has been removed and water which has been removed from the water-containing coal, wherein obtaining the mixture comprises:

heating water-containing coal at a temperature of 100° C. to 350° C. under a pressure not less than a saturated steam pressure at the temperature for the heating, while simultaneously applying a shearing force of 0.01 MPa to 20 MPa to the water-containing coal, in a sealed vessel; and subsequently removing the water from the mixture or adding water to the mixture, to adjust a water content in a final mixture to 30 weight % to 50 weight %, calculated on the basis of the mixture.

9. The method according to claim 8, wherein the water content in the final mixture is 40 weight % to 50 weight %.

10. A method comprising providing a mixture containing water which is removed from water-containing coal and coal from which the water is removed in a sealed vessel as obtained according to claim 1, subsequently removing the water from the mixture to isolate the coal from which the water was removed.

11. The method according to claim 10, wherein water is removed from the mixture so that the coal contains not more than 15 weight % of water, based a total amount of the coal and water.

12. The method according to claim 10, wherein water is removed from the mixture so that the coal is substantially separated from the water.

13. A method for preparing bitumen-containing coal, comprising adding 1 weight % to 25 weight % of bitumen, calculated on the basis of dry coal, to the coal obtained in the method according to claim 10.

14. The method according to claim 13, wherein an amount of the bitumen is 5 weight % to 20 weight %, based on the dry Coal.

15. The method according to claim 13, wherein the bitumen is natural asphalt, petroleum asphalt or coal tar.

16. The method of claim 1, wherein the pore volume of the water-containing coal is reduced by at least 68%.

17. The method according to claim 2, wherein the stirring blade is comprised of a plurality of blades of varying pitch, the pitch being greatest at a site nearest to a supply port.

* * * * *